US008801876B2

(12) United States Patent
Iseda et al.

(10) Patent No.: US 8,801,876 B2
(45) Date of Patent: Aug. 12, 2014

(54) NI-BASED ALLOY PRODUCT AND PRODUCING METHOD THEREOF

(75) Inventors: Atsuro Iseda, Kobe (JP); Hiroyuki Hirata, Neyagawa (JP); Hirokazu Okada, Kobe (JP); Hiroyuki Semba, Sanda (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/420,918

(22) Filed: Mar. 15, 2012

(65) Prior Publication Data

US 2012/0168038 A1 Jul. 5, 2012

Related U.S. Application Data

(63) Continuation of application No. PCT/JP2010/062358, filed on Jul. 22, 2010.

(30) Foreign Application Priority Data

Sep. 16, 2009 (JP) ..... 2009-214478

(51) Int. Cl.
*C21D 11/00* (2006.01)
*C22C 19/05* (2006.01)
*C22C 30/00* (2006.01)

(52) U.S. Cl.
USPC ..... 148/501; 148/428; 148/442; 148/507

(58) Field of Classification Search
CPC ..... C22C 19/05; C22C 30/00; C22F 1/00; C22F 1/10
USPC ..... 148/426, 555, 428, 442, 501, 507
See application file for complete search history.

(56) References Cited

U.S. PATENT DOCUMENTS 5,021,215 A * 6/1991 Sawaragi et al. ..... 420/584.1
5,437,743 A * 8/1995 Culling ..... 148/419

FOREIGN PATENT DOCUMENTS

| | | |
|---|---|---|
| EP | 1 357 198 | 10/2003 |
| EP | 1 717 330 | 11/2006 |
| JP | 61-179833 | 8/1986 |
| JP | 61-179835 | 8/1986 |
| JP | 64-11950 | 1/1989 |
| JP | 07-216511 | 8/1995 |
| JP | 10-096038 | 4/1998 |
| JP | 2000-129403 | 5/2000 |
| JP | 2002-212634 | 7/2002 |
| JP | 2004-003000 | 1/2004 |
| JP | 2005-60826 | 3/2005 |
| KR | 10-0532877 | 12/2005 |

* cited by examiner

*Primary Examiner* — Keith Walker
*Assistant Examiner* — Alexander Polyansky
(74) *Attorney, Agent, or Firm* — Clark & Brody

(57) ABSTRACT

[Problem to be Solved]
A Ni-based alloy product consisting of, by mass percent, C: 0.03 to 0.10%, Si: 0.05 to 1.0%, Mn: 0.1 to 1.5%, Sol.Al: 0.0005 to 0.04%, Fe: 20 to 30%, Cr: not less than 21.0% and less than 25.0%, W: exceeding 6.0% and not more than 9.0%, Ti: 0.05 to 0.2%, Nb: 0.05 to 0.35%, and B: 0.0005 to 0.006%, the balance being Ni and impurities, the impurities being P: 0.03% or less, S: 0.01% or less, N: less than 0.010%, Mo: less than 0.5%, and Co: 0.8% or less, wherein a value of effective B (Beff) defined by the formula, Beff (%)=B−(11/14)×N+(11/48)×Ti, is 0.0050 to 0.0300%, and the rupture elongation in a tensile test at 700° C. and at a strain rate of $10^{-6}$/sec is 20% or more. This alloy may contain one or more kinds of Cu, Ta, Zr, Mg, Ca, REM, and Pd.

8 Claims, 1 Drawing Sheet

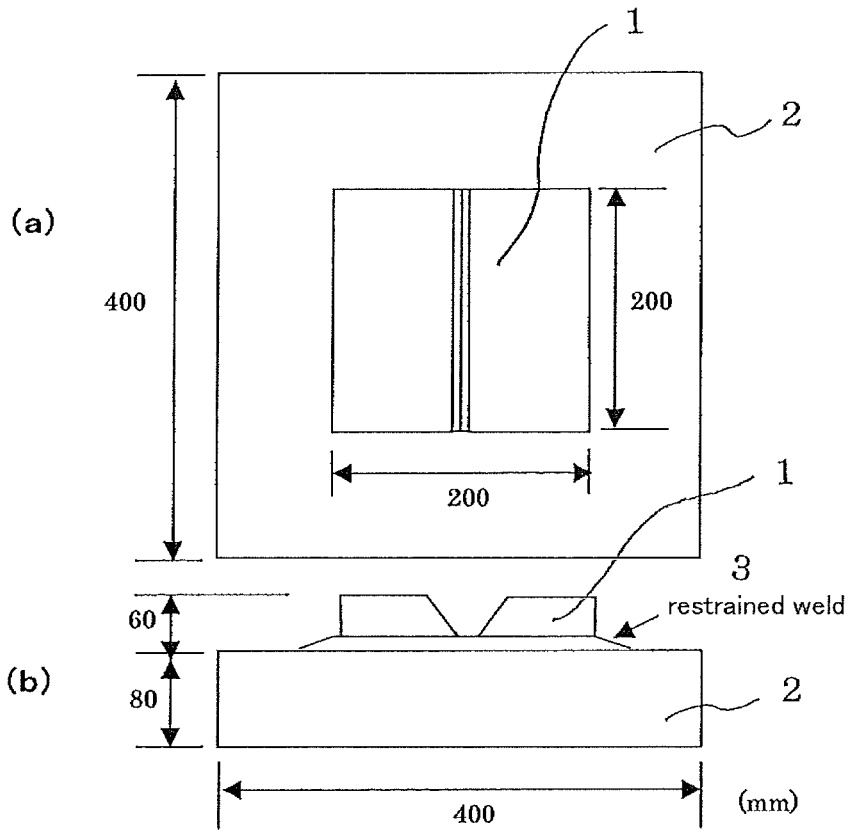
1
2
(a)
400
200
200
1
3
restrained weld
60
(b)
80
2
400
(mm)

NI-BASED ALLOY PRODUCT AND PRODUCING METHOD THEREOF

TECHNICAL FIELD

The present invention relates to a heat and pressure-resistant product for power generation boiler, the chemical industry use, and the like, for example, a Ni-based alloy product such as a tube and pipe, plate, bar, and forging, and a producing method therefor. This Ni-based alloy product has an excellent property such that the workability and the resistance to weld crack susceptibility at high temperatures are improved, and further the decrease in ductility caused by high-temperature aging is small. It is especially preferable that the Ni-based alloy product according to the present invention be used as a large-sized heat and pressure-resistant product in which the grains are liable to be coarsened at the production time and a brittle phase is liable to be formed.

BACKGROUND ART

In order to reduce $CO_2$ as a countermeasure against global warming, the increase in the power generation amount and the yield of chemical industry products with respect to the usage amount of fossil fuels caused by the enhancement in the efficiency of a power generation boiler, a synthetic reactor in the chemical industry, and the like has become a problem to be solved urgently. To solve this problem, various kinds of products, which are heat and pressure-resistant parts, are required to have high-temperature heat resistance and corrosion resistance that are more excellent than before. As the material for the product used in such a harsh environment, a material of Ni-based alloy that is more excellent in high-temperature strength and high-temperature corrosion resistance must be used in place of the conventional steel materials.

Unfortunately, the conventional Ni-based alloy is remarkably inferior in workability and weldability at high temperatures, and exhibits a significant decrease in ductility during heating at high temperatures as compared with the existing steel materials. Therefore, for the above-described heat and pressure-resistant product, especially for a product having a large wall thickness and a large product size, if the conventional Ni-based alloy is used, the production and usage of product are restricted remarkably.

As a typical example of the large-sized heat and pressure-resistant product, there are cited a plate material having a thickness of 40 mm or larger and a tube and pipe having a large size. For example, the main steam pipe of a power generation boiler has a size of about 500 mm in outside diameter, 50 mm in wall thickness, and 6 m in length. When such a large-sized product is produced, problems described below arise because the product has a size larger than that of a small-sized product such as a heat exchanger tube and a heating furnace tube.

Since the size of the material before hot working is large, the heating time is long, and further in all processes of hot working, only a small degree of working in which the rolling reduction ratio is about 3 can be performed. Therefore, the crystal grains are coarsened to about 0 in austenite grain size number, so that the grain boundaries are liable to be affected by the segregation of P and S. Also, the cooling rate after hot working or welding decreases remarkably, and a brittle phase is liable to precipitate in the cooling process. Therefore, hot working cracks and flaws during the production and cracks caused by the restraint during welding occur easily. Also, faults such as cracks may be caused by the decrease in ductility during the long-term use of actual equipment or cracks during repair welding.

For example, the alloy 617 (Ni base-22Cr-9Mo-12Co-1Al—Ti—(Fe<1.5%)), which has conventionally been known widely as a Ni-based alloy, has been regarded as very likely as a material for a next-generation power generation boiler. Unfortunately, this alloy is expensive because of a large amount of Co contained therein. Also, this alloy cannot be put to practical use as a material for a large-sized product, and has merely been used practically as a material having a relatively small size. If such a large-sized product, for example, having a main steam pipe size is produced by using this alloy, significant cracks will occur during hot working, and cracks and breakage will be caused during bending and welding by hardening and a significant decrease in ductility due to the precipitation of γ' phase. This is the reason why this alloy cannot be put to practical use as a material for a large-sized product.

Patent Document 1 discloses an austenitic stainless steel used at a steam temperature of 700° C. or higher and a producing method for the same. This steel is a material excellent in high-temperature strength and stability of microstructure. However, like the alloy 617, this steel has a fear that hot working cracks caused by low ductility during the production of a large-sized product or in the actual use of actual equipment may occur.

Patent Document 2 discloses a high-Cr austenitic heat-resistant alloy excellent in high-temperature strength and corrosion resistance. This alloy is a special material mainly aiming at precipitation strengthening caused by Cu-enriched phase and α-Cr phase by adding large amounts of Cu and Cr. As the product to which this alloy is applied, a heat exchanger tube and a heating furnace tube each having a relatively small size are assumed.

Patent Document 3 discloses a producing method for an austenitic heat-resistant steel tube excellent in high-temperature strength. As is apparent from the claims, this producing method is premised on cold rolling, so that this producing method is used for producing a small-sized steel tube. Cracks occurring during producing a large-sized steel tube and pipe, and cracks occurring during repair welding caused by the decrease in ductility when this steel tube and pipe is used for actual equipment are feared.

The invention disclosed in Patent Document 4 also relates to a small-sized superheater tube mainly developing corrosion resistance and strength at high temperatures, and therefore presents the same problems as described above. Further, Patent Document 5 and Patent Document 6 also disclose austenitic heat-resistant materials. These materials as well, like the above-described steel and the like, was developed mainly to provide high-temperature strength and high-temperature corrosion resistance, and was not developed by considering the improvement in workability and aging ductility of a large-sized product.

CITATION LIST

Patent Document

[Patent Document 1] JP2004-3000A
[Patent Document 2] JP10-96038A
[Patent Document 3] JP2002-212634A
[Patent Document 4] JP2000-129403A
[Patent Document 5] JP7-216511A
[Patent Document 6] JP61-179835A As described above, there has not been found so far a technique relating to a Ni-based alloy or an austenitic stainless steel that is used as a large-sized product, in which the improvement in workability and ductility during the production and use of actual equipment and the prevention of cracking are considered.

SUMMARY OF INVENTION

Technical Problem

An objective of the present invention is to provide a Ni-based alloy product for a heat and pressure-resistant product, which is used at high-temperatures, especially a product made of a Ni-based alloy that does not contain Co suitable as a large-sized product, and a producing method therefor. A further specific objective of the present invention is to greatly improve the workability at high temperatures and the decrease in ductility caused by high-temperature aging during producing the product and using the product as actual equipment.

Solution to Problem

First, the findings that were the basis of the present invention are described. An ideogram of "%" relating to the content of alloying element means "mass percent".

The present inventors conducted tests and studies to provide a novel Ni-based alloy product excellent in high-temperature strength, such as an improved hot workability that has not conventionally been considered sufficiently, an improved property to cracking during welding, a sufficient resistance to long-term deterioration and microstructure changes during the use of actual equipment, a high creep ductility, and an improved property to cracking even during repair welding. As the result, the present inventors obtained new findings as described below.

(a) By adopting a material that does not utilize γ' phase precipitation strengthening of Al and Ti, which have been added in large amounts in the conventional high-temperature and high-strength Ni-based alloy, a Ni-based alloy having excellent properties is obtained. Therefore, Co that is expensive and exerts an adverse influence on the workability as well need not be added.

(b) Although Co is not added to this Ni-based alloy, in order to provide an excellent high-temperature strength and to obtain a stable microstructure at a high temperature (500 to 800° C.) for a long period of time (100,000 hours or longer), it is necessary to optimize the Fe content so as to be 20 to 30%.

(c) In order to improve the hot workability and to prevent weld cracks, the amount of B that has necessarily to be added to the Ni-based alloy, which is defined by the value of "effective B (Beff)", should be specified together with achieving a proper balance among the contents of Ti, N and B, whereby hot working cracks and flaws can be prevented, and weld cracks and defects can be prevented while the high-temperature strength and workability are kept high.

Furthermore, the present inventors obtained entirely new findings of item (d) described below.

(d) The present inventors have found that, in order to prevent cracks caused by the decrease in creep ductility due to the long-term change of microstructure of Ni-based alloy product and to prevent cracks during repair welding, in addition to the definition of chemical components, the definition of rupture elongation in a tensile test at a low strain rate of $10^{-6}$/sec is a necessary requirement. According to the tensile test at a low strain rate of $10^{-6}$/sec, the hot workability, which could not been evaluated by the conventional high-temperature tensile test, the cracks caused by the decrease in ductility during use of actual equipment, and the susceptibility of repair weld cracks of a product having been used as actual equipment can be evaluated properly. That is, it is of very importance in property evaluation of alloy product that the rupture elongation in the tensile test at the low strain rate is used as an index.

The tensile test at a low strain rate of $10^{-6}$/sec is a highly accurate high-temperature tensile test in which the temperature and strain are controlled to conduct the test by spending about 3 hours to give a strain of 1% and spending about 27 hours to give a strain of 10% while a test temperature of 700° C. close to the temperature of usage as actual equipment is kept. The reason why the test temperature was set at 700° C. is that this temperature is close to the temperature of usage as actual equipment, and therefore, it was judged that this temperature is optimum in evaluating the deterioration in ductility and the like caused by the aging precipitation of material.

Cracking in hot working and welding is caused by a phenomenon that the properties of alloy are impaired significantly by the changes in microstructure produced by dynamic precipitation during working and welding. Because of not accompanying this dynamic precipitation in the conventional tensile test, the proper evaluation of material properties has been unable to be performed. The details are described in examples. It is one of the important features of the present invention to regulate the rupture elongation measured by the above-described new tensile test to a fixed value or larger.

Summarizing the above descriptions, the present invention was completed by adopting a Ni-based alloy which does not utilize γ' phase precipitation strengthening due to Ti and Al unlike the conventional Ni-based alloy for high-temperature and pressure-resistant part and to which Co is not added, by defining proper Fe content and the value of effective B, and further by defining the rupture elongation in the tensile test at a specially low strain rate of $10^{-6}$/sec as a fixed value or larger, which is a new finding.

The gists of the present invention are Ni-based alloy products and a producing method therefor described below.

(1) A Ni-based alloy product consisting of, by mass percent, C: 0.03 to 0.10%, Si: 0.05 to 1.0%, Mn: 0.1 to 1.5%, Sol.Al: 0.0005 to 0.04%, Fe: 20 to 30%, Cr: not less than 21.0% and less than 25.0%, W: exceeding 6.0% and not more than 9.0%, Ti: 0.05 to 0.2%, Nb: 0.05 to 0.35%, and B: 0.0005 to 0.006%, the balance being Ni and impurities, and the impurities being P: 0.03% or less, S: 0.01% or less, N: less than 0.010%, Mo: less than 0.5%, and Co: 0.8% or less, wherein the product has a composition such that the value of effective B (Beff) defined by Formula (1) is 0.0050 to 0.0300%, and the rupture elongation in a tensile test at 700° C. and at a strain rate of $10^{-6}$/sec is 20% or more:

$$\text{Beff}(\%)=B-(11/14)\times N+(11/48)\times Ti \quad (1)$$

where the symbols of element in Formula (1) indicate the content of the element (mass percent).

(2) The Ni-based alloy product according to the item (1) above, wherein the product further contains, by mass percent, at least one kind of element belonging to at least one group of the following first to fourth groups:

First group: Cu: 5.0% or less and Ta: 0.35% or less,

Second group: Zr: 0.1% or less,

Third group: Mg: 0.01% or less and Ca: 0.05% or less, and

Fourth group: REM: 0.3% or less and Pd: 0.3% or less.

(3) The Ni-based alloy product according to the item (1) or (2) above, wherein the product is a seamless tube and pipe, plate, or forging having a thickness of 30 mm or larger in finished dimension, or a bar having an outside diameter of 30 mm or larger in finished dimension.

(4) The Ni-based alloy product according to any one of the items (1) to (3) above, wherein the product has a coarse grain structure of an austenite grain size number of 3.5 or less.

(5) A method for producing the Ni-based alloy product according to any one of the items (1) to (4) above, comprising the steps of preparing a material that consists of a Ni-based alloy having a chemical composition described in the item (1) or (2) above, heating and holding at a temperature of 1000° C. or higher for 1 minute or longer, hot working, subjecting to final heat treatment, and cooling at a cooling rate of 800° C./hour or lower.

Advantageous Effects of Invention

The Ni-based alloy product according to the present invention is suitably used as a product, such as a tube, pipe, plate, bar, and forging, which is used as a heat and pressure-resistant part for power generation boiler, chemical industry use, and the like. The hot workability, the resistance to weld crack susceptibility, and the decrease in ductility caused by high-temperature aging of the product at the production time and the time of use of actual equipment are improved greatly.

BRIEF DESCRIPTION OF DRAWING

FIG. 1 shows the shape of a restraint weld crack test specimen, FIG. 1(*a*) being a plan view, and FIG. 1(*b*) being a side view.

DESCRIPTION OF EMBODIMENT

1. Chemical Composition of Ni-Based Alloy, which is a Material for Product of the Present Invention First, concerning the alloying elements of the Ni-based alloy that is a material for the product of the present invention (hereinafter, referred to as the "Ni-based alloy according to the present invention"), the functional advantages and the reason why the content is restricted are explained. An ideogram of "%" relating to the content of alloying element means "mass percent".

C: 0.03 to 0.10%

Carbon (C) is necessary to produce carbides of Ti, Nb and Cr, and to secure the high-temperature tensile strength and high-temperature creep rupture strength of the alloy. The content thereof must be 0.03% or more. On the other hand, if the C content is excessively high, undissolved carbides are produced, and carbides of Cr increase, which deteriorates the weldability. Therefore, the upper limit of the C content is 0.10%

Si: 0.05 to 1.0%

Silicon (Si) is an element necessary to act as a deoxidizing element for the alloy and also to raise the steam oxidation resistance. The lower limit of the content thereof is 0.05% to improve the steam oxidation properties and to secure the deoxidizing action. The preferable lower limit is 0.1%. On the other hand, a large amount of Si causes deterioration in workability due to the formation of sigma phase at high temperatures, and deteriorates the stability of microstructure. Therefore, the upper limit of the Si content is 1.0%. If importance is attached to the stability of microstructure, the upper limit is preferably 0.5%. The further preferable upper limit is 0.3%.

Mn: 0.1 to 1.5%

Manganese (Mn) renders S (sulfur) harmless by forming MnS (sulfide) with S, and improves the hot workability of the Ni-based alloy according to the present invention. If the content thereof is less than 0.1%, the effects are not achieved. On the other hand, if Mn is contained excessively, the Ni-based alloy becomes hard and brittle, and the workability and weldability are rather impaired. Therefore, the upper limit of the Mn content is 1.5%. The preferable Mn content is 0.7 to 1.3%

Sol.Al: 0.0005 to 0.04%

One of the features of the Ni-based alloy according to the present invention is that the γ' phase precipitation strengthening caused by the addition of large amounts of Al and Ti is not utilized from the viewpoint of attaching importance to the hot workability. Although Al acts as a deoxidizing element, if it is contained excessively, the structural stability deteriorates. Therefore, the upper limit of the Al content is 0.04% in Sol.Al. Also, to stably achieve the deoxidizing effect, the lower limit of the Al content is 0.0005% in Sol.Al. The preferable Sol.Al content is not less than 0.005% and less than 0.03%.

Fe: 20 to 30%

In the Ni-based alloy according to the present invention, in order to obtain a microstructure that has increased high-temperature strength and is stable at high temperatures for a long period of time without the addition of Co, 20% or more of iron (Fe) must be contained. Also, in order to secure the high-temperature ductility and workability and to produce stable carbo-nitrides of Nb, Ti and Cr, a proper amount of Fe must be contained. On the other hand, if the Fe content exceeds 30%, a brittle phase such as a sigma phase is formed, and therefore the high-temperature strength, toughness, and workability of the Ni-based alloy are impaired. Therefore, the upper limit of the Fe content is 30%.

Cr: Not Less than 21.0% and Less than 25.0%

Chromium (Cr) is an important element for securing the oxidation resistance, steam oxidation resistance, and corrosion resistance of the alloy. When the Ni-based alloy according to the present invention is used at a high temperature of about 500 to 800° C., the Cr content necessary to secure the corrosion resistance equivalent to or higher than the corrosion resistance of 18-8 stainless steel is 21.0% or more. With the increase in the Cr content, the corrosion resistance is raised. On the other hand, however, a brittle sigma phase is formed and thereby the stability of microstructure is decreased, which decreases the creep strength and weldability. Therefore, the Cr content should be kept to a value less than 25.0%. The preferable Cr content is 22.5 to 24.5%.

W: Exceeding 6.0% and not More than 9.0%

Tungsten (W) is an important solid-solution strengthening element for the Ni-based alloy according to the present invention. In order to achieve the solid-solution strengthening effect at a temperature of 700° C. or higher, at which temperature the grain sliding creep takes precedence, the W content exceeding 6.0% is needed. In the Ni-based alloy according to the present invention, since Mo is not added positively, no brittle phase is formed even if a large amount of W is added. On the other hand, however, if W is contained excessively, the Ni-based alloy is hardened, and the workability and weldability are deteriorated. Therefore, the upper limit of the W content is 9.0%. The preferable W content is 7.0 to 8.5%.

Ti: 0.05 to 0.2%

Titanium (Ti) has conventionally utilized, like Al, precipitation strengthening of γ' phase or carbo-nitride by being added positively to the Ni-based alloy. In the Ni-based alloy according to the present invention, however, a large amount of Ti causes deterioration in hot workability due to the increase in undissolved carbo-nitrides, and enhances the weld crack susceptibility. Therefore, the upper limit of the Ti content is 0.2%. On the other hand, an addition of a trace of Ti can stabilize N (nitrogen) as a nitride, and can enhance the high-temperature strengthening action of B. To achieve these effects, 0.05% or more of Ti must be contained. The preferable Ti content is 0.10 to 0.15%.

Nb: 0.05 to 0.35%

Niobium (Nb) must be contained in an amount of 0.05% or more to increase the creep strength on account of the carbides thereof. On the other hand, the upper limit of the Nb content is 0.35% so as not to impair the hot workability and weldability. The preferable Nb content is 0.20 to 0.30%.

B: 0.0005 to 0.006%

Boron (B) is an alloying element that is indispensable to the Ni-based alloy according to the present invention, and has a function for preventing grain boundary creep at high temperatures. On the other hand, an excessive amount of B induces cracks during producing a member having a thick wall and cracks during welding. Therefore, it is important to control the proper amount of B.

The B content in the Ni-based alloy according to the present invention must be 0.0005% or more to improve the strength and workability of the alloy. On the other hand, if the B content exceeds 0.006%, the weldability and workability are impaired remarkably. The preferable B content is 0.001 to 0.005%. The B content must be within the above-described range, and also must be such that the value of "effective B (Beff)" is within the range of 0.0050 to 0.0300%.

Effective B (Beff): 0.0050 to 0.0300%

The present inventors have found that the control of the value of "effective B" is important from the viewpoint of hot workability and prevention of weld cracks, and found the range of effective content in the correlation with N and Ti. The value of effective B (Beff) is defined by the following Formula (1).

$$\text{Beff}(\%)=B-(11/14)\times N+(11/48)\times Ti \quad (1)$$

The value of "effective B" is the B amount that is obtained by subtracting B consumed as BN (B nitride) from the total content of B, and contributes to workability and creep strengthening. Ti stabilizes and renders N harmless in preference to B as TiN and contributes to the value of effective B. Formula (1) is obtained by rearranging the following Formula (2).

$$\text{Beff}(\%)=B-(11/14)\times\{N-(14/48)\times Ti\} \quad (2)$$

In the improvement in hot workability, the prevention of weld cracks, and the prevention of the increase in crack susceptibility caused by a long-term deterioration during the use of actual equipment, which are main purposes of the present invention, the control of the value of "effective B" is a necessary requirement. If the value of the "effective B" is less than 0.0050%, sufficient hot workability and high-temperature strength cannot be obtained. On the other hand, if the value of "effective B" exceeds 0.0300%, the amount of inclusions such as oxides and carbides of B increases, which induces cracks during working and welding. Therefore, the proper range of the value of "effective B" is 0.0050 to 0.0300%. The preferable range thereof is 0.0050 to 0.0250%.

The Ni-based alloy according to the present invention has the above-described elements and the balance consisting of Ni and impurities. The "impurities" referred to herein are elements that enter while commercially producing an alloy on account of various factors in the production process, including from the ore and scrap used as raw materials, and are allowed to be present to the extent that they do not exert an adverse influence on the present invention. Among these impurities, especially concerning the elements described below, it is important to keep the content of each of the elements to the upper limit value described below or a lower value.

P: 0.03% or Less

Phosphorous (P) enters as an unavoidable impurity, and impairs the weldability and hot workability of the Ni-based alloy according to the present invention. Therefore, the upper limit of the P content is 0.03%. The P content is preferably reduced to 0.02% or less as far as possible.

S: 0.01% or Less

Sulfur (S) also enters as an unavoidable impurity, and impairs the weldability and hot workability of the Ni-based alloy according to the present invention. Therefore, the upper limit of the S content is 0.01%. The S content is preferably reduced to 0.005% or less as far as possible.

N: Less than 0.010%

Nitrogen (N) has conventionally been added to secure carbo-nitride precipitation strengthening and stability of high-temperature microstructure. In the Ni-based alloy according to the present invention, if the amount of undissolved carbo-nitrides of Ti and B increases, cracks during hot working and welding are induced. Therefore, the N content must be reduced as far as possible. However, N has a high affinity for Cr, and enters unavoidably during melting of alloy production. In order to achieve the effects of the present invention, the content of N entering as an impurity is less than 0.010%.

Mo: Less than 0.5%

Molybdenum (Mo) may form a brittle phase in the Ni-based alloy according to the present invention, and deteriorate the corrosion resistance in a usage environment of 700° C. or higher. Also, since the effect of compositely added Mo and W is not greater than the effect of singly added W, Mo is not added positively. The content of Mo allowed as an impurity is less than 0.5%. The Mo content is preferably less than 0.4%, further preferably less than 0.3%.

Co: 0.8% or Less

Cobalt (Co) is usually contained in an amount of 10% or more as a principal alloying element in the Ni-based alloy for the high temperature use. This is because Co is usually effective for high-temperature strength and stability of microstructure. In a thick-wall product, however, Co increases the strength excessively, lowers the ductility, and induces hot cracks. Also, Co is an expensive element, and may be not easily available because it is a strategic material. Therefore, it is unfavorable to use Co in large amounts for a large-sized product. The Ni-based alloy according to the present invention is intended to be a Ni-based alloy that is inexpensive and excellent in workability without containing Co. Therefore, Co is not added positively. However, since Co is liable to enter from raw materials unavoidably, the upper limit of the content of Co allowed as an impurity is 0.8%. It is further preferable to keep the Co content less than 0.5%.

The Ni-based alloy according to the present invention may contain, in addition to the above-described alloying elements, at least one kind of element selected from at least one of the following element groups.

First group: Cu: 5.0% or less and Ta: 0.35% or less

Second group: Zr: 0.1% or less

Third group: Mg: 0.01% or less and Ca: 0.05% or less

Fourth group: REM: 0.3% or less and Pd: 0.3% or less

Hereunder, the functional advantages of these elements are explained.

Cu: 5.0% or Less

Copper (Cu) can be contained if necessary. If contained, Cu contributes to high-temperature strength as a precipitation strengthening element. However, if the Cu content exceeds 5%, the creep ductility decreases remarkably. Therefore, in the case where Cu is contained, the upper limit of the content thereof is 5.0%. In order to stably achieve the effect arising from the containing of Cu, it is desirable to contain 0.01% or more of Cu. The preferable Cu content is 1 to 4%.

Ta: 0.35% or Less

Tantalum (Ta) can be contained if necessary. If contained, Ta functions as a precipitation strengthening element. However, if the Ta content exceeds 0.35%, the hot workability is impaired remarkably, and the weld crack susceptibility is increased. Therefore, the upper limit of the Ta content is 0.35%. In order to stably achieve the effect arising from the containing of Ta, it is desirable to contain 0.01% or more of Ta.

Zr: 0.1% or Less

Zirconium (Zr) can be contained if necessary. If contained, Zr functions a grain boundary strengthening at high temperatures, and contributes to creep strength. However, if the Zr content exceeds 0.1%, the amount of oxide-base inclusions increases, and the creep strength, thermal fatigue property, and ductility are impaired. In order to stably achieve the effect arising from the containing of Zr, it is desirable to contain 0.0005% or more of Zr. The preferable Zr content is 0.001 to 0.06%.

Mg: 0.01% or Less

Magnesium (Mg) can be contained if necessary. If Mg is contained, a minute amount of Mg has a deoxidizing effect, and stabilizes harmful S, thereby improving the hot workability. However, if the Mg content exceeds 0.01%, the amount of oxide-base inclusions increases. Therefore, the upper limit of the Mg content is 0.01%. In order to stably achieve the effect arising from the containing of Mg, it is desirable to contain 0.0005% or more of Mg.

Ca: 0.05% or Less

Calcium (Ca) can also be contained if necessary. If Ca is contained, a minute amount of Ca combines with S and stabilizes it, thereby improving the workability. However, if the Ca content exceeds 0.05%, the ductility and hot workability are rather impaired. Therefore, the upper limit of the Ca content is 0.05%. In order to stably achieve the effect arising from the containing of Ca, it is desirable to contain 0.0005% or more of Mg.

REM: 0.3% or Less, Pd: 0.3% or Less

Rare-earth metal (REM) and Palladium (Pd) can be contained if necessary. If contained, these elements are useful to form harmless and stable oxides and sulfides, and thereby improving the corrosion resistance, workability, creep ductility, thermal fatigue resistance, and creep strength. However, if the content of each of the elements exceeds 0.3%, the manufacturing cost increases, and the amount of inclusions such as oxides increases, so that not only the workability and weldability but also the toughness, high-temperature ductility, and fatigue property are impaired. Therefore, the upper limit of the content of each of the elements is 0.3%. In order to stably achieve the effects arising from the containing of REM or Pd, it is desirable to contain 0.001% or more of REM or Pd. The REM is the general term of seventeen elements, which consists of fifteen elements from La of atomic number 57 to Lu of atomic number 71 plus Y and Sc. One or more kinds selected from these elements can be contained. The content of REM means the total amount of the above-described elements.

Among the REM elements, Nd combines with S that impairs the hot workability, and renders S harmless, thereby improving the hot workability, toughness, and creep ductility significantly. Therefore, in the case where REM is contained, it is preferable to contain Nd. If Nd is contained, the upper limit of the Nd content is preferably 0.2%. In order to stably achieve the effects arising from the containing of Nd, the Nd content is preferably 0.01% or more, further preferably 0.05.

2. Definition of High-Temperature Ductility of Product of the Present Invention

A major feature of the Ni-based alloy product of the present invention is that the rupture elongation in the tensile test at 700° C. and at a strain rate of $10^{-6}$/sec is 20% or more.

As described above, in order to improve hot workability that is main purpose of the present invention and the susceptibility of weld crack and to prevent low-ductility creep cracks caused by the decrease in ductility during the use of actual equipment, it is necessary that the value of the rupture elongation in the tensile test at 700° C. and at a strain rate of $10^{-6}$/sec be 20% or more in addition to the containing of proper amounts of alloying elements. Less than 20% of the rupture elongation causes cracks during hot working and welding, and stress relaxation cracks during the use of actual equipment, and impairs the creep fatigue property. The preferable value of rupture elongation is 30% or more.

3. Size and Grain Size of Product of the Present Invention

The effects of the present invention are achieved for a product having any size and shape. In particular, for a large-sized product, that is, a thick-wall product, the effects are achieved remarkably. Therefore, the Ni-based alloy product of the present invention is suitably used as a large-sized product. The large-sized product includes a seamless tube and pipe, plate, and forging having a thickness of 30 mm or larger in finished dimension, and a bar having an outside diameter of 30 mm or larger in finished dimension.

The product of the present invention may have a coarse grain structure of an austenite grain size number of 3.5 or less. Further, the product is allowed to have a coarse grain structure of an austenite grain size number of 3.0 or less or less than 2.5. The reason for this is as described below.

If the product is small in size, the heating holding time of the material before hot working can be shortened. On the other hand, if the product is large in size, heating for a long time period is necessary to heat the material to the interior thereof uniformly. Therefore, the microstructure after hot working is coarsened. For the Ni-based alloy product of the present invention, however, even when the heating holding time is long and resultantly a coarse grain structure is formed, controlling the chemical composition and the value of rupture elongation in the tensile test above results in improving the hot workability and the susceptibility of weld crack and the decrease in ductility during caused by high-temperature aging. For this reason, the product of the present invention is preferably used for a large-sized product. Even for a product in which a coarse grain structure is formed because of its large size, that is, even for a product having a coarse grain structure of an austenite grain size number of 3.5 or less, further, even for a product having a coarse grain structure of an austenite grain size number of 3.0 or less or less than 2.5, excellent properties can be maintained.

4. Method for Producing Alloy Product of the Present Invention

As described above, the Ni-based alloy product of the present invention is preferably used for a large-sized heat and pressure-resistant part. In the case of a large-sized product, when the product is produced actually, the size of the material before hot working is large because of the large-sized product. Therefore, the heating time must be prolonged, and in hot working as well, a high working ratio cannot be attained. That is, for the conventional Ni-based alloy product, since the rolling reduction ratio at the working time is as low as about 3, the crystal grains are coarsened to an austenite grain size number of about 0, and are liable to be affected by the segregation of P and S at grain boundaries. Further, the cooling rate after hot working and welding becomes remarkably low, and a brittle phase is easily precipitated during cooling. Therefore, faults may occur such as significant working cracks during the production, cracks caused by the restraint during welding, cracks caused by the decrease in ductility during the use of actual equipment for a long period of time, and cracks during repair welding.

In the method for producing the Ni-based alloy product according to the present invention, the heating temperature of the material before hot working is set at 1000° C. or higher, and the holding time is set at 1 minute or longer. In the heating at a temperature lower than 1000° C. or for a holding time shorter than 1 minute, solidification segregation or undissolved deposits remain, and the ductility, toughness, and hot workability during hot working and use of actual equipment are impaired. The preferable heating temperature and holding time are 1050° C. or more and 1 minute or longer. In the case of a large-sized product, since the interior of product must be heated to a high temperature, the product is preferably held for 1 hour or longer. The upper limit of the heating time is not defined. In terms of working, a higher temperature is preferable to reduce deformation resistance. However, if the product is heated at a too high temperature, cracks caused by partial melt of material may be generated. Therefore, the upper limit of heating temperature should be preferably 1250° C. or lower.

For the large-sized product, the working ratio during hot working cannot be made high. Therefore, for the Ni-based alloy according to the present invention, in order to select a chemical composition that does not deteriorate the hot workability, the definition set forth by the above-described tensile test at low strain rate was introduced. In the present invention, therefore, the rolling reduction ratio of hot working may be 3.5 or lower. Further, even if the rolling reduction ratio is 3.0 or lower, the excellent properties of the product can be secured.

Next, the cooling rate after final heat treatment is described. If the product is small in size, the cooling rate after final heat treatment can be made a high rate of 900° C./hour or higher, and no brittle phase is formed at the cooling time. For the large-sized product, the cooling rate after final heat treatment decreases necessarily, and a brittle phase is easily formed. For the Ni-based alloy product of the present invention, however, even in the case where the cooling rate is low, controlling the chemical composition and the value of rupture elongation in the tensile test above results in improving the hot workability and the susceptibility of weld crack and the decrease in ductility during caused by high-temperature aging. Accordingly, in the method for producing the product of the present invention, the product is cooled at a cooling rate of 800° C./hour or lower corresponding to the cooling rate of the large-sized product. The cooling rate of 600° C./hour or lower is also allowed.

The temperature of final heat treatment is not subject to special restriction. However, in order to obtain a satisfactory creep strength, the temperature should preferably be 1150° C. or higher. The temperature is further preferably 1175° C. or higher, still further preferably 1200° C. or higher. However, if the product is heated at a too high temperature, the crystal grains are coarsened excessively, and the ductility, weldability, and properties in inspection using ultrasonic waves are impaired. Therefore, the temperature of final heat treatment should be preferably kept at 1260° C. or lower.

EXAMPLES

Table 1 gives the chemical compositions of test materials. Test materials Nos. 1 to 20 are the Ni-based alloy according to the present invention. As comparative materials, No. 21 (existing the alloy 617), No. 22 (existing the alloy 740), No. 23 (existing the alloy 236), and further Nos. 24 to 28 were prepared. Each of these 28 kinds of alloys was melted in a 50 kg vacuum melting furnace, and cast into an ingot having a diameter of 150 mm.

The ingot was hot forged to form a plate material having a thickness of 60 mm. Among these thick plates, the thick plates of alloys of Nos. 1 to 20 and Nos. 24 to 28 were heat treated at 1220° C. for 30 minutes, and thereafter were cooled at a cooling rate of about 700° C./hour.

The thick plates of alloys of Nos. 21, 22 and 23 were heat treated at 1150° C. for 30 minutes, and thereafter were air-cooled. Further, each of alloys of Nos. 20 and 21 was melted in a 3.5 ton vacuum furnace to form an ingot, and thereafter was formed into a tube having an outside diameter of 400 mm, a wall thickness of 60 mm, and a length of 4 m by using an Ehrhardt push bench type pipe-manufacturing press. Concerning the final heat treatment, the tube of alloy of No. 20 was heated at 1220° C. for 1 hour, and thereafter cooled at a cooling rate of about 700° C./hour, and the tube of alloy of No. 21 was heated at 1150° C. for 1 hour, and thereafter cooled at a cooling rate of about 700° C./hour.

In the tensile test at the low strain rate defined in the present invention, a round bar test specimen having an outside diameter of 6 mm and a gauge length of 30 mm was pulled at a strain rate of $10^{-6}$/sec in the state of being heated and held at 700° C. by using a "strain-controlled low-strain rate tensile testing machine", and the value of reduction of area of final rupture was measured. The results are additionally given in Table 1.

The grain size number was determined by polishing and etching a cross-section of test material and observing it under a microscope and by using the austenite grain size number specified in ASTM. The creep rupture test specimen was a round-bar test specimen having an outside diameter of 6 mm and a gage length of 30 mm, and the creep rupture test was conducted at 700° C. for 10,000 hours or longer.

In the Greeble hot workability test, a round-bar test specimen having an outside diameter of 10 mm and a length of 130 mm was pulled by being heated. In the Charpy impact test, a cut-out member was heated at 700° C. for 10,000 hours, and thereafter a 2-mm V-notch test specimen of 10×10 mm was prepared, and four test specimens were tested at 0° C. to determine the average value of absorbed energy.

For the restraint weld crack test shown in FIG. 1, an alloy plate 1 having a plate thickness of 60 mm, a width of 200 mm, and a length of 200 mm was prepared, a V-type groove having an angle of 30° and a root thickness of 1 mm being formed in the longitudinal direction of the alloy plate, and thereafter, the alloy plate was welded onto a plate of JIS G3106 SM400 steel 2 having a thickness of 80 mm, a width of 400 mm, and a length of 400 mm by restraint-welding four sides of the alloy plate 1 by using a covered arc electrode (JIS Z3224 DNiCrFe-3). Subsequently, multi-layer welding was performed in the groove by TIG arc welding using a welding wire (AWS A5.14 ERNiCrCoMo-1). The welded joint test specimen was aged by heating at 700° C. for 500 hours, and thereafter ten transverse cutting faces of the weld zone were examined under a microscope. Thereby, the presence of crack in the weld heat affected zone was evaluated to determine a crack rate.

The results of tests described above are summarized in Table 2.

TABLE 1

| | Test material | Chemical composition (mass %, the balance: Fe and impurities) | | | | | | | | | |
|---|---|---|---|---|---|---|---|---|---|---|---|
| | No. | C | Si | Mn | P | S | Fe | Cr | Mo | W | Ti |
| The invention | 1 | 0.036 | 0.15 | 0.15 | 0.003 | 0.003 | 29.89 | 21.03 | 0.01 | 6.02 | 0.05 |
| | 2 | 0.065 | 0.23 | 1.06 | 0.011 | 0.001 | 20.80 | 24.57 | 0.49 | 7.35 | 0.13 |
| | 3 | 0.080 | 0.21 | 1.49 | 0.015 | 0.001 | 21.33 | 23.03 | 0.03 | 7.96 | 0.11 |
| | 4 | 0.095 | 0.48 | 1.23 | 0.028 | 0.002 | 20.47 | 24.95 | 0.05 | 8.89 | 0.08 |
| | 5 | 0.075 | 0.25 | 0.95 | 0.021 | 0.003 | 22.04 | 21.79 | 0.28 | 8.95 | 0.10 |
| | 6 | 0.060 | 0.33 | 0.32 | 0.007 | 0.001 | 25.00 | 24.78 | 0.01 | 7.04 | 0.16 |
| | 7 | 0.077 | 0.20 | 0.71 | 0.013 | 0.001 | 22.34 | 23.90 | 0.22 | 6.86 | 0.12 |
| | 8 | 0.070 | 0.28 | 1.33 | 0.012 | 0.002 | 24.70 | 22.98 | 0.17 | 7.83 | 0.11 |
| | 9 | 0.083 | 0.17 | 1.19 | 0.010 | 0.001 | 21.80 | 23.80 | 0.38 | 7.42 | 0.10 |
| | 10 | 0.072 | 0.31 | 1.07 | 0.016 | 0.002 | 23.00 | 22.78 | 0.07 | 7.09 | 0.07 |
| | 11 | 0.060 | 0.49 | 0.98 | 0.011 | 0.001 | 22.09 | 23.56 | 0.01 | 8.20 | 0.08 |
| | 12 | 0.071 | 0.21 | 1.17 | 0.009 | 0.001 | 21.07 | 24.02 | 0.06 | 7.29 | 0.07 |
| | 13 | 0.081 | 0.05 | 1.32 | 0.005 | 0.001 | 25.09 | 24.00 | 0.02 | 6.71 | 0.14 |
| | 14 | 0.055 | 0.25 | 0.55 | 0.001 | 0.001 | 28.33 | 24.55 | 0.01 | 8.01 | 0.11 |
| | 15 | 0.083 | 0.32 | 0.47 | 0.003 | 0.002 | 21.02 | 21.08 | 0.45 | 7.83 | 0.07 |
| | 16 | 0.073 | 0.44 | 0.22 | 0.006 | 0.001 | 29.90 | 23.75 | 0.49 | 7.70 | 0.09 |
| | 17 | 0.069 | 0.07 | 1.48 | 0.011 | 0.002 | 25.00 | 24.21 | 0.01 | 7.55 | 0.11 |
| | 18 | 0.063 | 0.48 | 1.32 | 0.027 | 0.002 | 22.71 | 23.98 | 0.03 | 7.09 | 0.13 |
| | 19 | 0.071 | 0.33 | 1.00 | 0.009 | 0.001 | 23.33 | 22.48 | 0.27 | 7.81 | 0.12 |
| | 20 | 0.082 | 0.30 | 1.10 | 0.004 | 0.003 | 24.21 | 23.00 | 0.39 | 6.99 | 0.10 |
| The comparative | 21 | 0.062 | 0.12 | 0.10 | 0.005 | 0.001 | *1.82 | 22.78 | *9.08 | *— | *0.43 |
| | 22 | 0.034 | 0.54 | 0.32 | 0.006 | 0.002 | *0.71 | 24.89 | *0.50 | *— | *1.87 |
| | 23 | 0.065 | 0.23 | 0.35 | 0.008 | 0.001 | *0.31 | 21.25 | *6.01 | *— | *2.13 |
| | 24 | 0.075 | 0.25 | 0.95 | 0.021 | 0.003 | 22.04 | 21.79 | 0.28 | 8.95 | 0.11 |
| | 25 | 0.062 | 0.57 | 1.36 | 0.024 | 0.002 | 23.00 | *25.05 | 0.32 | 7.85 | 0.13 |
| | 26 | 0.092 | 0.44 | 1.09 | 0.021 | 0.005 | 26.90 | *20.70 | 0.13 | 9.24 | *0.22 |
| | 27 | 0.031 | 0.48 | 1.48 | *0.031 | 0.005 | 29.00 | 24.79 | 0.01 | 8.77 | 0.08 |
| | 28 | 0.096 | 0.46 | 0.17 | *0.032 | 0.007 | 21.09 | 24.89 | 0.38 | 8.92 | 0.09 |

| | Test material | Chemical composition (mass %, the balance: Fe and impurities) | | | | | Effective B Beff | Rupture Elongation |
|---|---|---|---|---|---|---|---|---|
| | No. | Nb | B | sol. Al | N | その他 | (%) | (%) |
| The invention | 1 | 0.34 | 0.0015 | 0.037 | 0.0098 | | 0.0053 | 55 |
| | 2 | 0.23 | 0.0025 | 0.0006 | 0.0032 | | 0.0298 | 62 |
| | 3 | 0.21 | 0.0023 | 0.027 | 0.0078 | Nd = 0.16 | 0.0214 | 79 |
| | 4 | 0.30 | 0.0010 | 0.036 | 0.0064 | | 0.0143 | 45 |
| | 5 | 0.15 | 0.0058 | 0.022 | 0.0007 | Nd = 0.05 Ca = 0.0007 | 0.0282 | 73 |
| | 6 | 0.28 | 0.0006 | 0.009 | 0.0097 | Mg = 0.0014 | 0.0296 | 33 |
| | 7 | 0.22 | 0.0019 | 0.004 | 0.0083 | | 0.0229 | 70 |
| | 8 | 0.27 | 0.0025 | 0.035 | 0.0068 | Zr = 0.02 | 0.0224 | 64 |
| | 9 | 0.34 | 0.0045 | 0.033 | 0.0081 | Ca = 0.0015 | 0.0211 | 35 |
| | 10 | 0.22 | 0.0018 | 0.037 | 0.0022 | | 0.0161 | 76 |
| | 11 | 0.21 | 0.0019 | 0.033 | 0.0010 | Ta = 0.21 | 0.0194 | 69 |
| | 12 | 0.08 | 0.0022 | 0.026 | 0.0088 | Cu = 3.3 | 0.0113 | 61 |
| | 13 | 0.22 | 0.0020 | 0.027 | 0.0072 | | 0.0284 | 50 |
| | 14 | 0.10 | 0.0030 | 0.022 | 0.0038 | Pd = 0.01 | 0.0252 | 42 |
| | 15 | 0.28 | 0.0017 | 0.017 | 0.0059 | | 0.0131 | 78 |
| | 16 | 0.33 | 0.0010 | 0.008 | 0.0065 | Y = 0.11 | 0.0165 | 65 |
| | 17 | 0.24 | 0.0025 | 0.024 | 0.0073 | Nd = 0.11 La = 0.10 | 0.0220 | 78 |
| | 18 | 0.26 | 0.0015 | 0.022 | 0.0081 | Ce = 0.05 Hf = 0.01 Cu = 0.05 | 0.0249 | 83 |
| | 19 | 0.21 | 0.0018 | 0.039 | 0.0080 | | 0.0230 | 68 |
| | 20 | 0.30 | 0.0013 | 0.001 | 0.0079 | | 0.0180 | 75 |
| The comparative | 21 | *— | 0.0045 | *1.23 | *0.0123 | *Co = 12.3 | *0.0867 | *5 |
| | 22 | *2.08 | 0.0032 | *0.97 | 0.0089 | *Co = 21.0 | *0.4247 | *3 |
| | 23 | *— | *0.0076 | *0.45 | *0.0110 | *Co = 20.5 | *0.4871 | *2 |
| | 24 | 0.35 | 0.0062 | 0.022 | 0.0011 | | *0.0305 | *15 |
| | 25 | 0.30 | 0.0027 | 0.019 | 0.0070 | | 0.0270 | *9 |
| | 26 | 0.05 | 0.0057 | 0.023 | *0.0109 | | *0.0476 | *8 |
| | 27 | *0.37 | 0.0058 | 0.006 | 0.0096 | | 0.0166 | *16 |
| | 28 | *0.36 | 0.0059 | 0.034 | 0.0098 | | 0.0188 | *19 |

Note:

The value attached with * shows out of scope of the

TABLE 2

| | Test material No. | Grain size (ASTM) | 1200° C. Greeble test Rupture reduction of area (%) | Material heated at 700° C. for 500 hr ratio (%) of restraint weld crack | Material heated at 700° C. for 10000 hr Charpy absorbed energy (J) at 0° C. | Creep rupture strenght (Mpa) at 700° C. for 10000 hr (*) | Creep rupture reduction of area (%) at 700° C. for 10000 hr (**) |
|---|---|---|---|---|---|---|---|
| The invention | 1 | 2.4 | 85 | 0 | 138 | 110 | 48 |
| | 2 | 1.6 | 82 | 0 | 121 | 125 | 57 |
| | 3 | 3.0 | 75 | 0 | 165 | 115 | 35 |
| | 4 | 2.1 | 83 | 0 | 142 | 121 | 65 |
| | 5 | 0.6 | 70 | 0 | 172 | 145 | 42 |
| | 6 | 1.2 | 90 | 0 | 111 | 120 | 50 |
| | 7 | 3.0 | 88 | 0 | 116 | 138 | 47 |
| | 8 | 2.3 | 76 | 0 | 160 | 147 | 63 |
| | 9 | 3.0 | 70 | 0 | 132 | 142 | 44 |
| | 10 | 1.6 | 82 | 0 | 129 | 123 | 57 |
| | 11 | 2.2 | 77 | 0 | 115 | 121 | 46 |
| | 12 | 1.0 | 89 | 0 | 154 | 109 | 37 |
| | 13 | 3.0 | 80 | 0 | 120 | 135 | 61 |
| | 14 | 2.9 | 72 | 0 | 132 | 119 | 77 |
| | 15 | 2.3 | 79 | 0 | 119 | 132 | 65 |
| | 16 | 3.0 | 83 | 0 | 148 | 110 | 48 |
| | 17 | 2.4 | 79 | 0 | 175 | 118 | 72 |
| | 18 | 1.6 | 74 | 0 | 155 | 128 | 45 |
| | 19 | 0.4 | 81 | 0 | 143 | 114 | 59 |
| | 20 | 1.3 | 88 | 0 | 152 | 132 | 45 |
| The comparative | 21 | 3.6 | 0 | 100 | 44 | 183 | 11 |
| | 22 | 4.5 | 0 | 100 | 15 | 205 | 7 |
| | 23 | 5.0 | 0 | 100 | 20 | 223 | 2 |
| | 24 | 4.8 | 47 | 80 | 57 | 123 | 19 |
| | 25 | 3.8 | 53 | 70 | 90 | 132 | 11 |
| | 26 | 4.5 | 35 | 60 | 76 | 118 | 17 |
| | 27 | 3.7 | 42 | 60 | 55 | 145 | 11 |
| | 28 | 4.6 | 51 | 50 | 89 | 132 | 5 |

Note:
* and ** mean interpolated values to 700° C. and 10000 hr.

For all of Nos. 1 to 20, which are examples of the present invention, the rupture elongation in the tensile test at the low strain rate of $10^{-6}$/sec given in Table 1 was 30% or more. In contrast, for Nos. 21, 22 and 23, which are existing Ni-based alloys, the rupture elongation was merely several percent, being remarkably poor. Further, for Nos. 24 to 28, which are comparative examples, the rupture elongation was less than 20%, which did not reach the value of 20% or more defined in the present invention.

Concerning the grain size, as shown in Table 2, in all examples, the product had a coarse grain structure of an austenite grain size number of 3.0 or less because the heating time before hot working was prolonged assuming the large-sized product and because the working ratio was low. Even in the case of significant coarse grain of an austenite grain size number less than 2.5, examples of the present invention exhibited excellent properties.

Concerning the rupture reduction of area in the 1200° C. Greeble test, which is an index of the high-temperature hot workability of material, all the examples of the present invention showed good ductility of 70% or more in reduction of area. In contrast, in comparative examples, the reduction of area was 53% or less, and therefore the ductility, that is, the hot workability was poor. In particular, in Nos. 21, 22 and 23, which are the existing Ni-based alloys, since the alloy does not contain Fe, the melting point of grain boundary portion was lower than 1200° C., and grain boundary melting occurred, so that the reduction of area became 0%. It was found that these existing Ni-based alloys cannot be worked by being heated at 1200° C., and therefore the heating temperature must be lowered, so that the hot working is restricted extremely.

Next, in the restraint weld crack test, in all examples of the present invention, cracks did not occur, whereas in comparative examples, cracking was significant. Hereby, if only one crack is found in the examination under a microscope, the material is rejected. It is apparent that the example of the present invention is an excellent Ni-based alloy having low weld crack susceptibility.

Concerning the toughness after aging of 700° C.×10,000 hours, all the examples of the present invention had high toughness of 111 J or higher, whereas in comparative examples, the toughness was lower than 90 J. In particular, in Nos. 21, 22 and 23, which are the existing Ni-based alloys, the toughness was very poor, being lower than 50 J. It was revealed that these existing alloys are materials that are very unsuitable as the material for a large-sized and thick-wall product.

In the 700° C. creep rupture test, in all examples of the present invention, the rupture reduction of area was high, being 30% or more, while a practically sufficient strength of 100 MPa or higher was attained. It was proven that the Ni-based alloy of the present invention has sufficient strength and ductility as a large-sized and thick-wall product even after the high-temperature and long-term use of actual equipment. On the other hand, in comparative examples, although the strength was sufficient, the rupture reduction of area was low, being less than 20%. It became apparent that the alloys of comparative examples are materials that are unsuitable as the material for a large-sized and thick-wall product.

Further, for No. 20 alloy of example of the present invention from which a large-diameter thick wall pipe (finished outside diameter: 400 mm, wall thickness: 50 mm) equivalent to actual equipment were prepared, a large-sized product could be produced without problem by Ehrhardt push bench type hot forging. For No. 21 of existing alloy, large flaws and inner surface cracks occurred during pipe-making, and therefore repairing work was repeated, so that a pipe having predetermined dimensions could not be produced. It became apparent that as compared with example of the present invention, in alloys of comparative examples, the hot workability of large-sized product for actual equipment was poor.

INDUSTRIAL APPLICABILITY

The present invention is to provide a Ni-based alloy product that is suitable as a product, such as a tube and pipe, plate, bar, and forging, used for a heat and pressure-resistant part for power generation boiler, the chemical industry use, and the like, especially as a large-sized product. In this product, the hot workability, the resistance to weld crack susceptibility, and the decrease in ductility caused by high-temperature aging during production and use of actual equipment are improved remarkably.

REFERENCE SIGNS LIST

1: Alloy plate of test material
2: Plate of JIS G3106 SM400 steel
3: Restraint weld

The invention claimed is:

1. A Ni-based alloy product consisting of, by mass percent, C: 0.03 to 0.10%, Si: 0.05 to 1.0%, Mn: 0.1 to 1.5%, Sol.Al: 0.0005 to 0.04%, Fe: 20 to 30%, Cr: 21.0 to 23.8%, W: 7.0 to 9.0%, Ti: 0.05 to 0.2%, Nb: 0.05 to 0.35%, and B: 0.0005 to 0.006%, the balance being Ni and impurities, and the impurities being P: 0.03% or less, S: 0.01% or less, N: less than 0.010%, Mo: less than 0.5%, and Co: 0.8% or less.

2. A Ni-based alloy product consisting of, by mass percent, C: 0.03 to 0.10%, Si: 0.05 to 1.0%, Mn: 0.1 to 1.5%, Sol.Al: 0.0005 to 0.04%, Fe: 20 to 30%, Cr: 21.0 to 23.8%, W: 7.0 to 9.0%, Ti: 0.05 to 0.2%, Nb: 0.05 to 0.35%, and B: 0.0005 to 0.006%, and at least one element selected from the group consisting of Cu: 5.0% or less, Ta: 0.35% or less, Zr: 0.1% or less, Ca: 0.05% or less, REM: 0.3% or less and Pd: 0.3% or less, with the balance being Ni and impurities, and the impurities being P: 0.03% or less, S: 0.01% or less, N: less than 0.010%, Mo: less than 0.5%, and Co: 0.8% or less.

3. The Ni-based alloy product according to claim 1, wherein the product is a seamless tube or pipe, plate, or forging having a thickness of 30 mm or larger in finished dimension, or a bar having an outside diameter of 30 mm or larger in finished dimension.

4. The Ni-based alloy product according to claim 2, wherein the product is a seamless tube or pipe, plate, or forging having a thickness of 30 mm or larger in finished dimension, or a bar having an outside diameter of 30 mm or larger in finished dimension.

5. The Ni-based alloy product according to claim 1, wherein the product has a coarse grain structure of an austenite grain size number of 3.5 or less.

6. The Ni-based alloy product according to claim 2, wherein the product has a coarse grain structure of an austenite grain size number of 3.5 or less.

7. The Ni-based alloy product according to claim 3, wherein the product has a coarse grain structure of an austenite grain size number of 3.5 or less.

8. The Ni-based alloy product according to claim 4, wherein the product has a coarse grain structure of an austenite grain size number of 3.5 or less.

* * * * *